United States Patent [19]

Brown

[11] Patent Number: 4,807,553

[45] Date of Patent: Feb. 28, 1989

[54] RETRACTABLE RUDDER FOR LIGHT-WEIGHT TROLLING MOTOR PROPELLED FISHING BOAT

[76] Inventor: Randal J. Brown, 205 W. Hopewell Manor, Plant City, Fla. 33566

[21] Appl. No.: 100,422

[22] Filed: Sep. 24, 1987

[51] Int. Cl.[4] ..... B63H 25/06

[52] U.S. Cl. ..... 114/152; 114/162; 114/165

[58] Field of Search ..... 114/163, 165, 126, 152; 940/6, 7

[56] References Cited

U.S. PATENT DOCUMENTS 4,211,180 7/1980 Brooks, Jr. ..... 114/162 X

*Primary Examiner*—Sherman D. Basinger

*Attorney, Agent, or Firm*—Fleit, Jacobson, Cohn & Price

[57] ABSTRACT

A light-weight fishing boat is provided including an electric trolling motor mounted from one end portion thereof for actuation and steering control thereof by a fisher person disposed on the boat hull and the other end of the boat hull supports a stationary rudder panel exteriorly of the boat and below the water line thereof with the rudder panel being of the non-steerable type, disposed in a plane generally paralleling the longitudinal center line of the boat and having a periphery enclosing a rudder panel area of at least 115 square inches. The rudder panel stabilizes the light-weight fishing boat against wind action on the associated boat hull end and allows precise movement, positioning and orientation of the light-weight boat hull by the operator of the electric trolling motor with a minimum amount of power consumed by the trolling motor.

2 Claims, 1 Drawing Sheet

RETRACTABLE RUDDER FOR LIGHT-WEIGHT TROLLING MOTOR PROPELLED FISHING BOAT

BACKGROUND OF THE INVENTION

1. Field of the Invention

This invention relates to a fixed, but upwardly retractable, rudder for one end of a light-weight fishing boat hull of the type including a fishing person actuatable and steerable trolling motor mounted from the other end of the hull.

2. Description of Related Art

Various different forms of permanently mounted as well as upwardly retractable fins, rudders or skegs heretofore have been used in conjunction with various different forms of boat hulls and water skis as well as other forms of water planing devices. Examples of typical forms of rudders, fins and skegs of this type are disclosed in U.S. Pat. Nos. 1,302,362, 2,593,806, 3,066,327, 3,572,279, 4,325,154 and 4,597,348. However, these previously known rudders, fins and skegs are not utilized in the same overall combination including a light-weight boat hull having a fishing person actuatable and steerable trolling motor at one end of the hull and an upwardly retractable stationary rudder at the other end of the hull.

SUMMARY OF THE INVENTION

A light-weight fishing boat often is used by fishing persons when drifting or fishing a shore line and in most cases such light-weight fishing boats are provided with bow mounted and fishing person actuatable and steerable trolling motors and stern end upwardly retractable outboard motors, which outboard motors are upwardly retracted during such a fishing operation.

Although an outboard motor may be retained in the lowered position to define a type of sea anchor at the stern end of a boat and an associated bow mounted trolling motor may be selectively actuated and steered by a fishing person on the associated boat, the lower unit of an outboard motor includes a stationary propeller and an extremely small amount of surface area to define a rudder. The stationary propeller creates appreciable drag on the boat and thus requires considerably more operation of the trolling motor in order to maintain position in a current or to move from one location to another. Further, the lower unit of an outboard motor is very inefficient as a rudder and, therefore, does not offer slow relative water speed control to the associated boat.

The main object of this invention is to provide an upwardly retractable, but non-steerable, large elevational outline rudder for the end of a light-weight boat opposite the end thereof equipped with a fishing person actuable and steerable trolling motor.

Another object of this invention is to provide a position controlling rudder in accordance with the preceding objects and which may be readily mounted on various different types of light-weight fishing boats.

Yet another object of this invention is to provide a position controlling rudder for light-weight fishing boats utilizing mounting structure therefor semi-permanently attached to the associated fishing boat and from which the rudder may be readily dismounted.

A further object of this invention, in accordance with the immediately preceding object, is to provide a position controlling rudder for a light-weight fishing boat equipped with an electric trolling motor and wherein the position controlling rudder may be upwardly swung to a retracted position above the water level on the associated fishing boat.

Yet another object of this invention is to provide a position controlling rudder for a light-weight fishing boat which may be stern mounted or mounted from one of the side gunnels of a light-weight fishing boat adjacent the stern thereof.

A final object of this invention to be specifically enumerated herein is to provide a position controlling rudder for a light-weight fishing boat equipped with an electric trolling motor and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
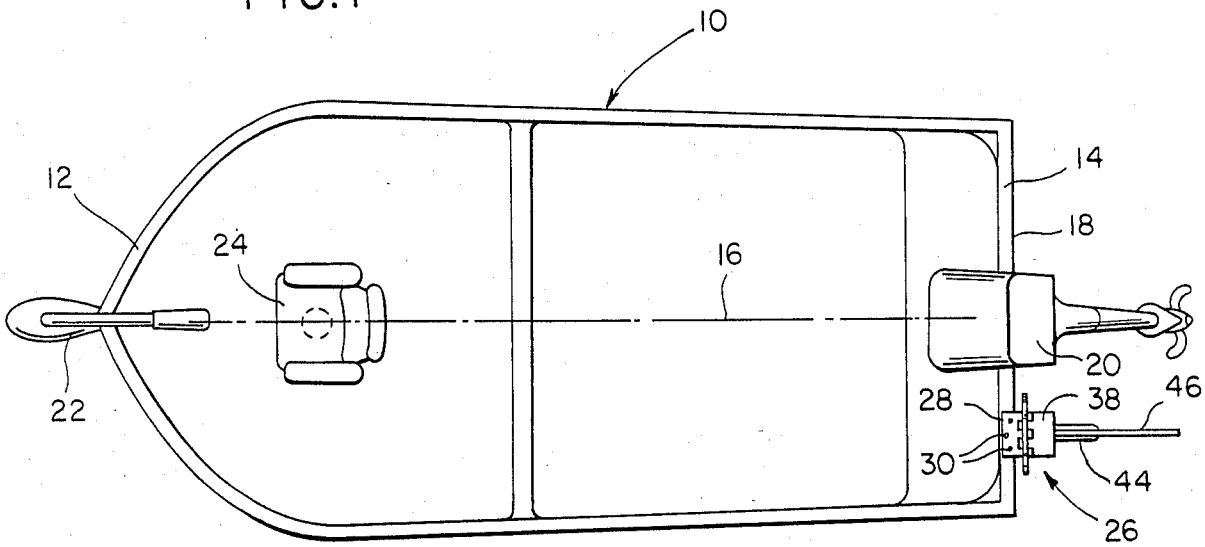
FIG. 1 is a top plan view of a light-weight fishing boat equipped with an upwardly retracted and centrally mounted outboard motor, a bow mounted fisherman actuatable and steerable electric trolling motor and a stern mounted upwardly retractable position maintaining rudder constructed in accordance with the present invention.

Referring now more specifically to the drawings, the numeral 10 generally designates a light-weight fishing boat including a first bow end portion 12 and a second stern end portion 14. It is to be noted that the plan shape and type of the hull of the boat 10 may vary and that the boat or hull includes a longitudinal center line 16 and defines a predetermined exterior water level.

The second or stern end portion 14 incorporates a transom 18 from which a conventional outboard motor 20 is mounted, the motor 20 being illustrated in FIG. 1 in an upwardly retracted and forwardly pivoted position. When the motor 20 is in a rearwardly pivoted and downwardly projecting position, the motor 20 is mounted for oscillation about an upstanding axis for steering the boat 10 when under propulsion by the outboard motor 20.

Further, the bow end portion 12 has an electric trolling motor 22 supported therefrom for actuation and steerage by a fishing person seated in a bow seat such as that indicated at 24. In addition, a fishing person also may actuate and control the trolling motor 32 from a standing position.

The trolling rudder of the instant invention is referred to in general by the reference numeral 26 and includes a mount 28 mounted from the port side of the transom 18 through the utilization of suitable fasteners 30 and the mount 28 defines a stationary hinge leaf and is equipped with aligned hinge barrels 32 through which a readily removable hinge pin 34 is received.

The rudder 26 additionally includes an upstanding support shank 36 from whose upper end a second hinge leaf 38 is supported by welding 40 and the hinge leaf 38 includes aligned hinge barrels 42 which may be interdigitated with the hinge barrels 32 and receive the hinge pin 34 therethrough, thereby pivotally supporting the hinge leaf 38 from the stationary hinge leaf or mount 28.

The lower end of the support shank is curved as at 44 and has an edge upstanding rudder panel 46 supported therefrom by welding 48.

It will be noted from FIG. 1 of the drawings that the edge upstanding rudder panel 46 is disposed in a vertical plane paralleling the longitudinal center line 16 of the boat or hull 10. Furthermore, the rudder panel 46 is disposed at least substantially entirely beneath the aforementioned predetermined water level of the boat or hull 10. Further, the elevational outline of the rudder panel 46 encompasses an area therein which is at least approximately 115 square inches, the preferred dimensions of the rudder panel being generally 21½ inches in horizontal length and 10¾ inches in vertical height. Furthermore, the rudder panel 46 may be constructed of aluminum sheet having a thickness of substantially 3/32 inch and the support shank 36 may be constructed of ¾inch aluminum conduit bent as at 44.

The support shank 36 is supported from the second stern end portion 14 of the boat 10 against angular displacement about an upstanding axis, although the support shank 36, rudder panel 46 and hinge leaf 38 may be swung about the horizontal transverse axis defined by the hinge pin 34 so as to upwardly retract the rudder panel 46 from the water. In addition, the hinge pin 34 may be quickly removed so as to entirely disconnect the support shank 36 and hinge leaf 38 from the stationary mount or hinge leaf 28.

Figure 2:
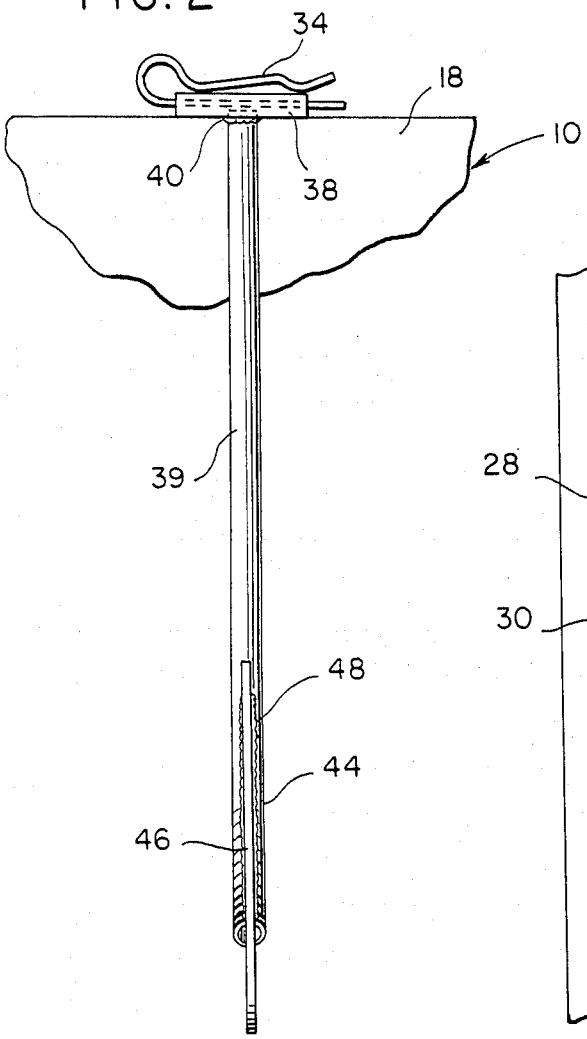
FIG. 2 is an enlarged fragmentary rear elevational view of the position controlling rudder illustrated in FIG. 1 and the adjacent supportive transom portion of the boat.
Figure 4:
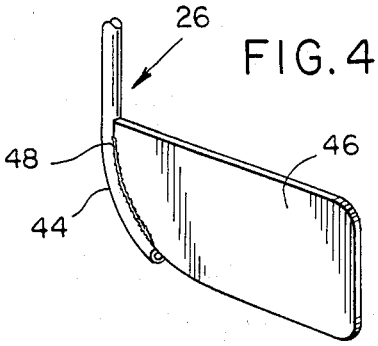
FIG. 4 is a fragmentary perspective view of the rudder panel portion of the position controlling rudder illustrating the manner in which the rudder panel portion is mounted from a rearwardly curving lower end portion of the supportive shank therefor.
Figure 3:
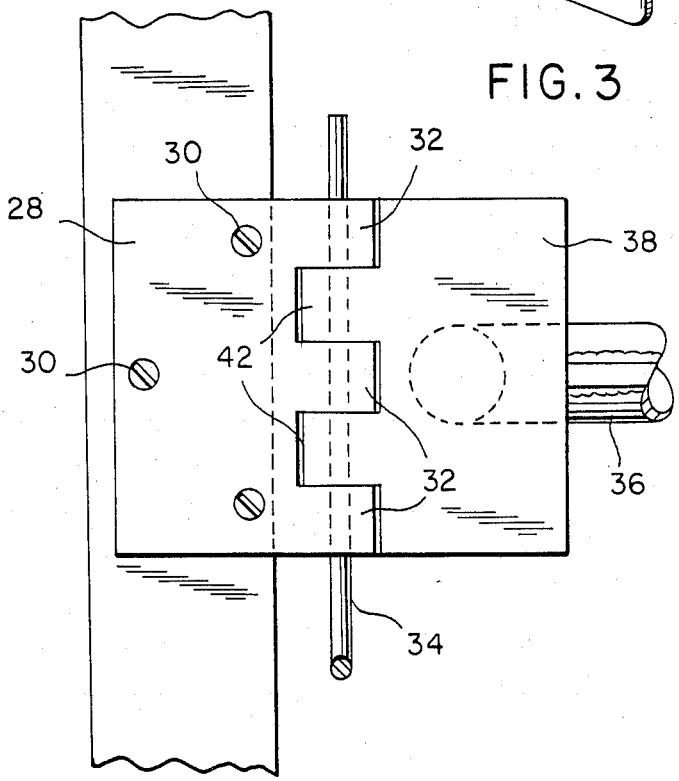
FIG. 3 is a further enlarged fragmentary plan view of the mounting portion of the position controlling rudder illustrated in FIG. 2.

In operation, once the outboard motor 20 has been tilted forwardly so as to raise the propeller equipped lower unit thereof above water level, the rudder 26 may be positioned as illustrated in FIGS. 1 and 2 of the drawings. Then, a fisher person seated in the bow seat 24 may actuate and steer the electric trolling motor 22 as desired along a bank or to maintain the position of the boat 10 against a current flow. The operating speed of the trolling motor 22 may be maintained at a minimum inasmuch as the rudder panel 46 offers very little water drag and operation of the trolling motor 22 at the bow end portion 12 of the boat 10 and utilization of the rudder panel 46 at the stern end portion 14 of the boat 10 insures that wind will not blow the boat 10 from its intended course. If wind blows across the stern end portion of a light-weight fishing boat not equipped with the rudder 26, the stern end portion 14 of the boat 10 will tend to swing in a downwind direction, even though the fisher person attempting to control the attitude of the boat 10 may wish to maintain the boat in a different attitude relative to the wind. However, by use of the rudder 26, the action of wind on the stern of the boat 10 will be greatly minimized and the operator of the trolling motor 22 may proceed as desired or maintain his position in a current. At this point, it is stressed that position and attitude of the boat 10 relative to a precise distant water area into which a fisher person desires to cast is extremely important in many fishing situations.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. In combination with a light-weight fishing boat hull of the type including a longitudinal center line, a predetermined water line and bow and stern end portions, a fishing person actuatable and steerable trolling motor mounted from said bow end portion of said hull, mounting means mounted from stern end portion of said hull, an elongated upstanding support shank having upper and lower end portions, support means mounting the upper end portion of said support shank from said mounting means with said shank depending downwardly therefrom and terminating downwardly exteriorly of said hull, an edge upstanding rudder panel mounted from said lower end portion, disposed in an upstanding plane generally paralleling the longitudinal center line of said hull and with at least a major portion of the elevational outline of said rudder panel disposed below said water line, said support means mounting said shank from said mounting means against angular displacement about an upstanding axis relative to said boat hull, said stern end portion of said hull including a transom, said mounting means being mounted from said transom, said support means including release means supporting said shank from said mounting means for ready disengagement therefrom, said mounting means comprising a hinge leaf stationarily mounted from said transom and including axially spaced hinge barrels, said support means including a second hinge leaf stationarily mounted from the upper end of said support shank and including axially spaced hinge barrels interdigitated and aligned with the first mentioned hinge barrels, said release means including a hinge pin readily removably axially passed through the first and second mentioned hinge barrels.

2. The boat hull of claim 1 wherein said rudder panel includes a side elevational outline bounding an are of at least 115 square inches or approximately 0.8 square feet.

* * * * *